US007866514B1

(12) United States Patent
Hansen

(10) Patent No.: US 7,866,514 B1
(45) Date of Patent: Jan. 11, 2011

(54) CONTAINER AND DEVICE FOR PRODUCTION OF SUCH CONTAINER

(76) Inventor: Bernd Hansen, Talstr. 22-30, 74429 Sulzbach-Laufen (DE)

( * ) Notice: Subject to any disclaimer, the term of this patent is extended or adjusted under 35 U.S.C. 154(b) by 1024 days.

(21) Appl. No.: 11/366,022

(22) Filed: Mar. 2, 2006

(30) Foreign Application Priority Data

Mar. 1, 2006 (DE) ..... 10 2006 009 766

(51) Int. Cl.
*B65D 47/10* (2006.01)

(52) U.S. Cl. ..... 222/541.6; 215/47

(58) Field of Classification Search ..... 222/48, 222/541.6, 153.07, 153.06, 568, 573, 420, 222/541.7, 541.8, 541.9, 541.1, 266.1, 129; 215/47, 45, 42, 6, 49, 48, 41, 46, 414
See application file for complete search history.

(56) References Cited

U.S. PATENT DOCUMENTS 1,104,607 A * 7/1914 Gerber ..... 239/327
2,342,372 A 2/1944 Scherer
2,811,283 A 10/1957 Bowen
3,977,553 A 8/1976 Cornett, III et al.
3,993,223 A 11/1976 Welker, III et al.
4,176,153 A * 11/1979 Weiler et al. ..... 264/524
4,349,056 A 9/1982 Heino
4,458,818 A 7/1984 Hansen
4,478,342 A 10/1984 Slater et al.
4,502,616 A * 3/1985 Meierhoefer ..... 222/215
4,566,613 A * 1/1986 Anscomb ..... 222/541.9
4,671,763 A * 6/1987 Weiler ..... 425/525
4,787,536 A * 11/1988 Widerstrom ..... 222/212
4,821,897 A 4/1989 Weiler
D309,097 S * 7/1990 Price ..... D9/696
4,948,356 A 8/1990 Dundas et al.
5,076,452 A * 12/1991 Hashimoto ..... 215/48
5,188,250 A * 2/1993 Kovacic et al. ..... 215/48
5,228,593 A * 7/1993 O'Meara ..... 222/41
5,409,125 A * 4/1995 Kimber et al. ..... 215/48
5,520,677 A * 5/1996 Hansen ..... 604/403
5,553,732 A 9/1996 Kani
5,761,885 A * 6/1998 Hansen ..... 53/452
5,839,609 A * 11/1998 Zakensberg ..... 222/107
5,897,009 A 4/1999 O'Meara
5,901,865 A 5/1999 Weiler et al.
5,908,124 A 6/1999 Klauke et al.

(Continued)

FOREIGN PATENT DOCUMENTS

DE 2 59 204 4/1912

(Continued)

*Primary Examiner*—Lien T Ngo
(74) *Attorney, Agent, or Firm*—Roylance, Abrams, Berdo & Goodman LLP

(57) ABSTRACT

A container has a hollow receptacle element (10) for holding a medium to be dispensed, and a dispensing opening (12) communicating with a hollow chamber (14) of a sealing element (18). The sealing element (18) is detachable by a point of separation (20). To reduce the free volume of the hollow chamber (14), opposite wall components (22) of the sealing element (18) are displaced into the hollow chamber (14). The dispensing medium stored in the receptacle element (10) is prevented from being able to unintentionally penetrate into the hollow chamber (14) where it would no longer being available for a removal process. The invention also relates to a device for production of such a container.

13 Claims, 4 Drawing Sheets

U.S. PATENT DOCUMENTS

| | | | | |
|---|---|---|---|---|
| 5,944,206 | A | 8/1999 | Culter et al. | |
| 6,068,148 | A | 5/2000 | Weiler | |
| 6,619,516 | B2 * | 9/2003 | Weiler et al. | 222/420 |
| 6,626,308 | B2 | 9/2003 | Weiler | |
| 7,185,790 | B2 * | 3/2007 | Weiler | 222/153.07 |
| 7,188,750 | B2 * | 3/2007 | Vogel et al. | 222/83 |
| 2004/0078010 | A1 * | 4/2004 | Ahlstrom et al. | 604/301 |
| 2004/0182883 | A1 * | 9/2004 | Weiler | 222/153.07 |

FOREIGN PATENT DOCUMENTS

| | | |
|---|---|---|
| DE | 38 31 957 | 12/1989 |
| DE | 102 02 907 | 9/2002 |
| DE | 103 23 335 | 12/2004 |
| FR | 1283152 | 2/1962 |
| GB | 832056 | 4/1960 |
| WO | WO 01/89940 | 11/2001 |

* cited by examiner

CONTAINER AND DEVICE FOR PRODUCTION OF SUCH CONTAINER

FIELD OF THE INVENTION

The present invention relates to a container, a hermetically sealed ampule in particular, having a hollow receptacle element for holding a medium to be dispensed. The container has a dispensing opening communicating outside the receptacle element, with a hollow chamber of a sealing element forming the head component of the container. The hollow chamber keeps the dispensing opening clear. The sealing element is detachably connected to the receptacle element by a point of separation in the area of the dispensing opening. The present invention furthermore relates to a device for producing the container according to this configuration.

BACKGROUND OF THE INVENTION

Containers of the indicated type are used in particular to store media of the most varied type to be dispensed in the hollow receptacle element. For example, the media is in the form of medical solutions, suspensions and/or semisolid preparations such as gels. To quickly clear the dispensing opening of the receptacle element, a sealing element forms the head component of the container, and can be separated from the remaining receptacle element in a so-called twist-off motion as a toggle sealing element by a given point of separation.

So that the dispensing opening provided in the receptacle element is not unintentionally sealed during the molding process for the container at the point of separation, the sealing element has a hollow chamber. The hollow chamber carries fluid or media, undergoes transition into the receptacle element by the dispensing opening, and surrounds its side edge otherwise bordered to the outside by the wall components of the container. If the sealing element is separated from the remaining receptacle element at the point of separation when the toggle closure is being opened by the twist-off motion, the hollow chamber for this purpose also provides for the dispensing opening remaining open with its original initial shape. For example, bordering wall components of the container are not pushed against each other such that closure of the dispensing opening might unintentionally occur.

To be able to ensure unimpeded dispensing of the medium to be dispensed and held in the receptacle element, the free cross section of the dispensing opening must be dimensioned to be correspondingly large. Likewise, the free entry cross section of the hollow chamber must be large. The latter however then results in the disadvantage that the medium stored in the receptacle element overflows into the hollow chamber and then can no longer flow back, especially when the fluid medium stored in the hollow chamber is held in the hollow chamber due to its surface tension. If part of the medium to be dispensed remains in the hollow chamber, it is lost for a removal process from the container. This loss is especially disadvantageous when exact dosing is critical during dispensing or the medium to be dispensed is inherently very expensive or when exact mixing ratios and concentrations for later use are critical when suspensions are being dispensed.

DE 102 02 907 A1 suggests providing a hermetically sealed container with an improved closure to prevent loss of the pertinent active agent. These proposed measures alone can still result in loss of the active agent in the hollow chamber of the sealing element designed as the head component. As part of a dispensing opening, the known container has a delivery mouthpiece and a hollow closure section with an elevated region. The closure section is connected to the delivery mouthpiece by a tear strip as the point of separation.

The elevated region in the hollow closure section partially reduces retention of liquid drops on the inside of the closure section. The delivery mouthpiece has a wall tapering to the top and inside in a straight line and designed to cause the liquid drops or liquid portions in the closure section and in the delivery mouthpiece to flow back down into the body section of the container with the hollow receptacle element. Consequently, liquid is no longer sprayed when the closure section is separated from the delivery mouthpiece as part of the dispensing opening along the tear strip as the point of separation.

In spite of these measures, especially for fluid media with a high surface tension, it is possible that they will settle in the remaining hollow chamber volume and will then not be available for removal. The container walls necessarily provided and extending in a straight line in the area of the delivery mouth piece limit the free shape of container geometries. The known containers can be obtained within the scope of a conventional blow-fill-seal process.

SUMMARY OF THE INVENTION

An object of the present invention is to provide an improved container such that the medium to be dispensed no longer remains in the hollow chamber of the head or sealing element and cannot be returned by the essentially funnel-shaped geometries of the dispensing opening to the receptacle element as the actual container interior. Within the larger framework, free container shaping tailored to customer specifications and to aspects of practicability is possible.

This object is basically achieved by a container where, to reduce the free volume of the hollow chamber, the opposite wall components of the sealing element are displaced into the hollow chamber to prevent the dispensing medium stored in the receptacle element from being able to penetrate into the hollow chamber. In contrast to the known solution, no elevated wedge-shaped or dome-shaped region is on the free top end of the hollow closure section of the head component as a hollow chamber. Rather, the facing wall sections that border the hollow chamber are moved toward each other. In this way, the arrangement reduces the free chamber volume, since the facing wall sections are displaced into the hollow chamber, leading to markedly improved volume reductions.

The opposite adjacent wall components displaced toward the dispensing opening into the hollow chamber transversely or obliquely thereto reduce the hollow chamber volume. The medium to be dispensed, even in the form of a very thin liquid medium, then cannot travel at all into the hollow chamber, but remains in the hollow receptacle element. In this respect, in the present invention, the problem does not arise of having to return to the container interior the medium to be dispensed which penetrates into the hollow chamber by the oblique surfaces of the delivery mouth piece extending in a straight line. Rather, for this purpose, the shape of the dispensing opening and delivery mouthpiece can be freely selected within a widely drawn framework, making possible short longitudinal dimensions in implementation, especially in the axial direction of the container.

The hollow chamber, in particular in the form of a ball, is also used during shaping the plastic material over an "edge". Such shaping can reduce the wall thickness of the plastic material for forming desired point of separation.

A device according to the present invention used to produce the container of the present invention has at least two mold jaws for producing the head component of the container. Those mold jaws in turn have mold recesses for the hollow chamber and for the wall components of the sealing element bordering the hollow chamber. These devices are readily available on the market in a plurality of embodiments and permit a so-called blow-fill-seal process, as has become known in the trade under the brand name "Bottelpack®", for example.

On the basis of these known devices, the device of the present invention is characterized in that mold parts can be triggered within the mold recesses which relate to the hollow chambers. These parts facing each other in the retracted position enable complete formation of the hollow chamber. In the extended position, they move the adjacent wall components of the hollow chamber toward each other as the free chamber volume is reduced in molding. These mold parts, by preference are designed as pneumatically driven plungers, can be housed in a space-saving design within the respective mold jaws with their mold recesses, and can be triggered in a timely and controlled manner. By integrating the additional mold parts within the mold jaws space-saving accommodation is ensured, as is a reliable configuration which can be implemented cost-efficiently.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which are schematic and not to scale, and which form a part of this disclosure.

DETAILED DESCRIPTION OF THE INVENTION

Figure 1:
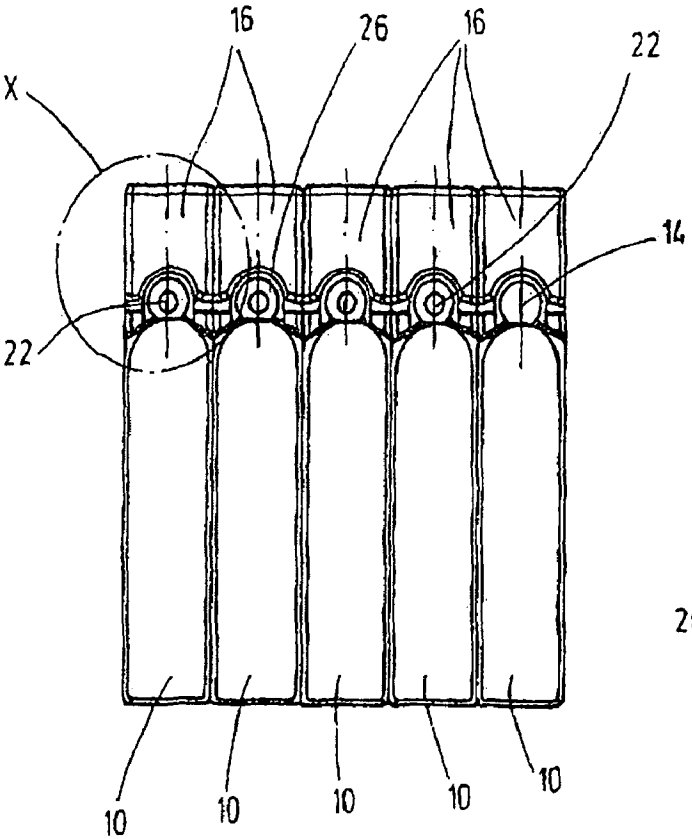
FIG. 1 is a front elevational view of a container combination of five individual containers, with the container at the extreme right relating to an execution according to the prior art and the remaining containers being according to an exemplary embodiment of the present invention.

The container according to an exemplary embodiment of the present invention is made in particular in the form of a hermetically sealed ampule. A combination of five of these containers is shown in FIG. 1, the individual containers being separable from each other along their adjoining longitudinal side edges to form an individual container. Almost any number of rows of or numbers of containers to be manufactured, as well as individual containers, can be produced.

The containers are produced from a moldable plastic material, for example, a polyamide or a polyethylene material. Furthermore, these container products can be produced in a co-extrusion process with a multilayer wall structure or with a coating on the plastic to increase its impermeability, for example, by vacuum-coating the container on the outside. By preference, materials are used that can be easily used for a blow-fill-seal process, and are known in the trade under the brand name "Bottelpack®", for example.

Each container has a hollow, blow-molded receptacle element 10 used to hold a medium (not detailed) to be dispensed among others in the form of medical liquids, suspensions, gels or the like added under sterile conditions. As FIG. 3 in particular shows, the receptacle element 10 for dispensing the stored medium to be dispensed is provided with a dispensing opening 12 communicating outside the receptacle element 10 with the hollow chamber 14 of a sealing element 18. The sealing element 18 forms the head component 16 of the container. Chamber 14 keeps the dispensing opening 12 clear. Sealing element 18 is detachably connected to the receptacle element 10 by a point of separation or separation point 20 in the area of the dispensing opening 12. This point of separation 20 can be formed by a plastic wall component having a reduced wall thickness and extending between the head component 16 and the receptacle element 10.

This point of separation 20 is designed in such that the head component or sealing element 16, 18 can be easily twisted off of the receptacle element 10 in the form of a toggle closure by hand (twist-off closure) to clear the dispensing opening 12 for the process of removal of the medium to be dispensed. This separation process is known in the prior art in a plurality of embodiments, as are readily available on the market, so that they will not be explained in further detail.

As viewed in FIG. 1, a container 10 on the extreme right is shown provided with the conventional hollow chamber design. This hollow chamber 14 is designed as a ball. The ball's lower enclosing edge ensures that, both during the molding process for the container and also later when the head component 16 is being separated, the dispensing opening 12 does not unintentionally seal, but remains open for the desired removal process.

The ball shape of the hollow chamber 14 ensures that the plastic material molded the molding tool can be formed by edge 27 (FIG. 5) to reduce the plastic material to form of the desired point of separation 20.

At this point, the medium to be dispensed and stored in the receptacle element 10 can reach the hollow chamber 14. Encouraged by the respective surface tension of the medium to be dispensed, the medium will remain in the hollow chamber 14 with the result that the medium to be dispensed and held in the hollow chamber 14 will no longer be available for the subsequent dispensing process by the actual hollow receptacle element 10. This missing amount cannot be tolerated, especially when high-precision dosing is important, the medium to be dispensed is very expensive and/or the prescribed or desired concentration enters as a factor with respect to the mixtures and suspensions accommodated in the receptacle element.

In contrast thereto, the other four containers of the container designed according to the present invention, located on the left in FIG. 1, following the conventional solution, have a reduced free volume of the hollow chamber 14. The opposite wall components 22 of the sealing element 18 are displaced into the hollow chamber 14 in order in this way to prevent the medium which is to be dispensed and which is stored in the receptacle element 10 from being able to penetrate into the hollow chamber 14 at all.

Preferably, as shown in the figures, the displaced wall components 22 of the sealing element 18 extend transversely to the dispensing opening 12. In this way, within a widely drawn framework, a relatively large contact surface arises for the opposite wall components 22 which for this purpose are also in contact with each other transversely to the longitudinal axis 24 of the container (compare FIGS. 2 and 3) and are displaced against each other. Depending on the embodiment, the wall components 22 can be displaced to meet each other in the opposite direction at an oblique angle (not shown).

Because the two opposite wall components 22 can move uniformly toward each other, a favorable afterflow behavior for the other plastic material is created, so that tension peaks in the shaping process and thus possible failure points are avoided. The uniform displacement motion of the two wall components 22 for one hollow chamber 14 ensures that the sensitive area of the dispensing opening is not touched, especially to ensure than the free enclosing edge of the dispensing opening in terms of cross section is preserved and to ensure a smooth removal process later. For efficient process control, it is advantageous that the opposite wall components 22 displaced adjacent to each other touch within the hollow chamber 14 of the sealing element 18. For operation of the present invention, it would however also be sufficient simply to at any rate move the wall components 22 toward each other to such an extent that the remaining free chamber cross section of the hollow chamber 14 has a reduced holding volume. The medium to be dispensed then cannot reach the hollow chamber 14 due to its surface tension.

Figure 3:
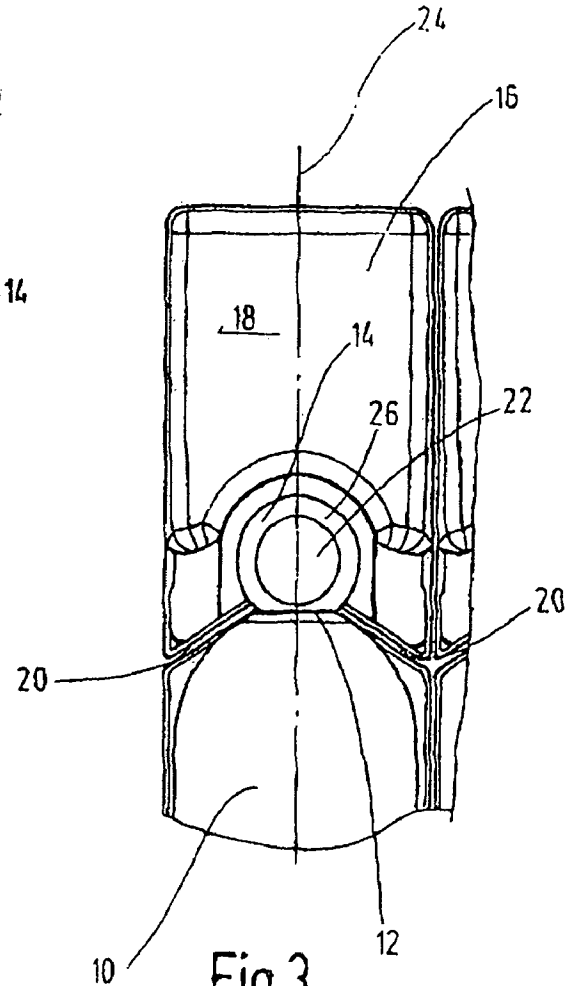
FIG. 3 is an enlarged, front elevational view of the sealing element shown at extreme left in FIG. 1 within the circle "X"

As FIGS. 1 and 3 show, the displaced wall components 22 touching each other within the hollow chamber 14 leave an annular chamber segment 26 exposed. This configuration with respect to the afterflow behavior of the plastic material constitutes an optimum for the actual shaping and the holding capacity for the medium to be dispensed. Regardless, it is however possible in special container geometries or for implementation of special Luer-Lock forms to define the opposite wall components which have been displaced toward each other differently (not detailed). The annular space in the form of the annular chamber segment 26 viewed in the direction of the figures from overhead discharges into the dispensing opening 12, for allowing pressure equalization relative to the receptacle element 10. The medium to be dispensed could not then be unintentionally sucked out of the receptacle element 10 in the direction of the hollow chamber 14, for example, by vacuum effects. This effect also applies when separation by the point of separation 20 is being carried out.

Figure 2:
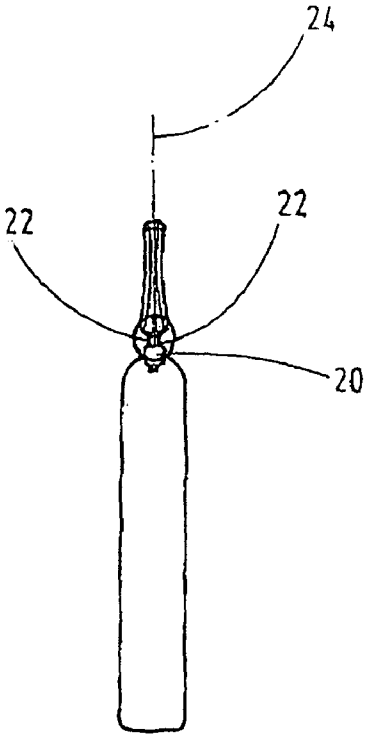
FIG. 2 is a side elevational view of the combination shown in FIG. 1.
Figure 4:
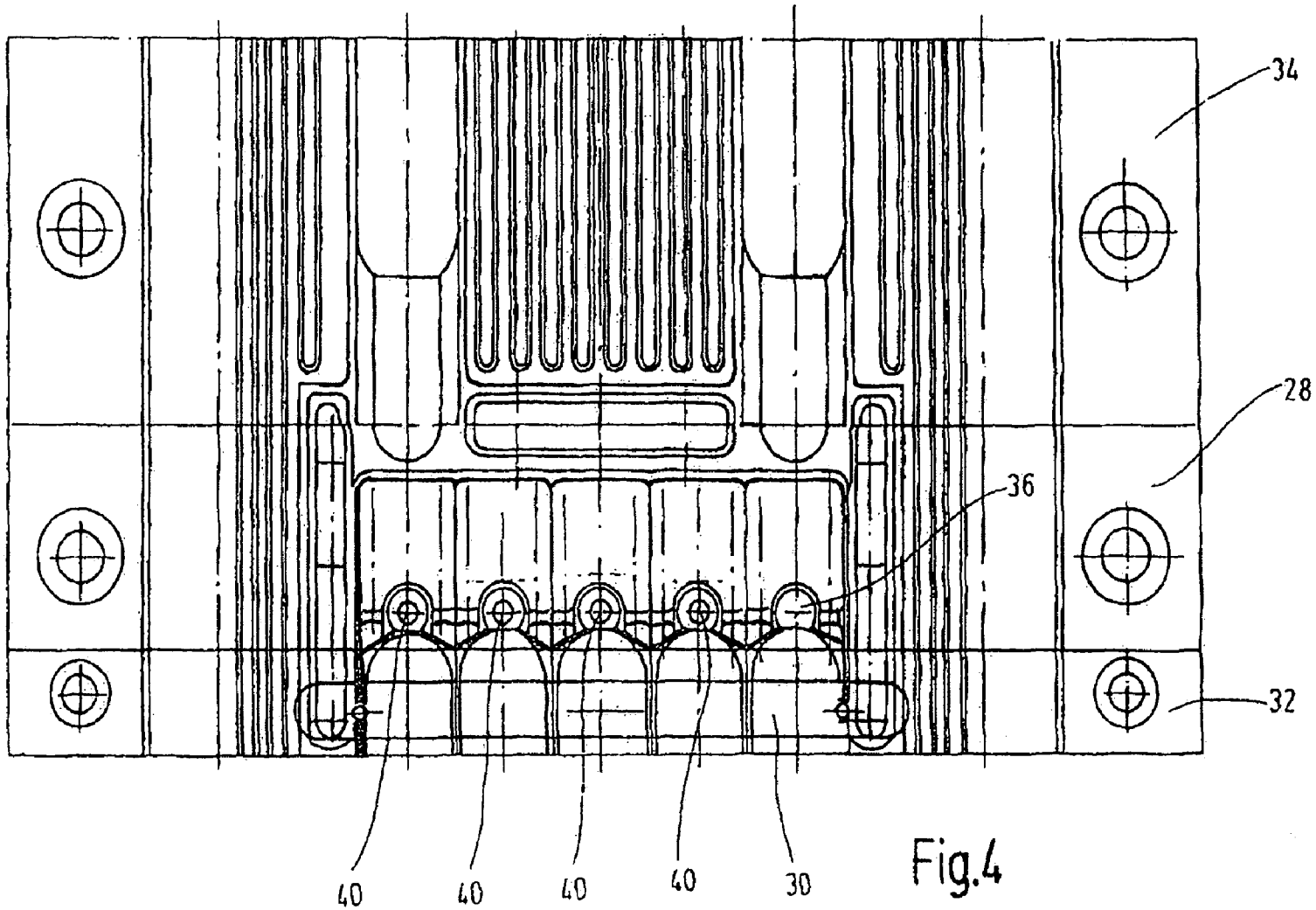
FIG. 4 is a front elevational view of the components of the mold jaw for producing the container geometry shown in FIG. 3 according to an exemplary embodiment of the present invention, the actual container produced by the molding tool not being shown in FIG. 4 for the sake of simpler representation.
Figure 5:
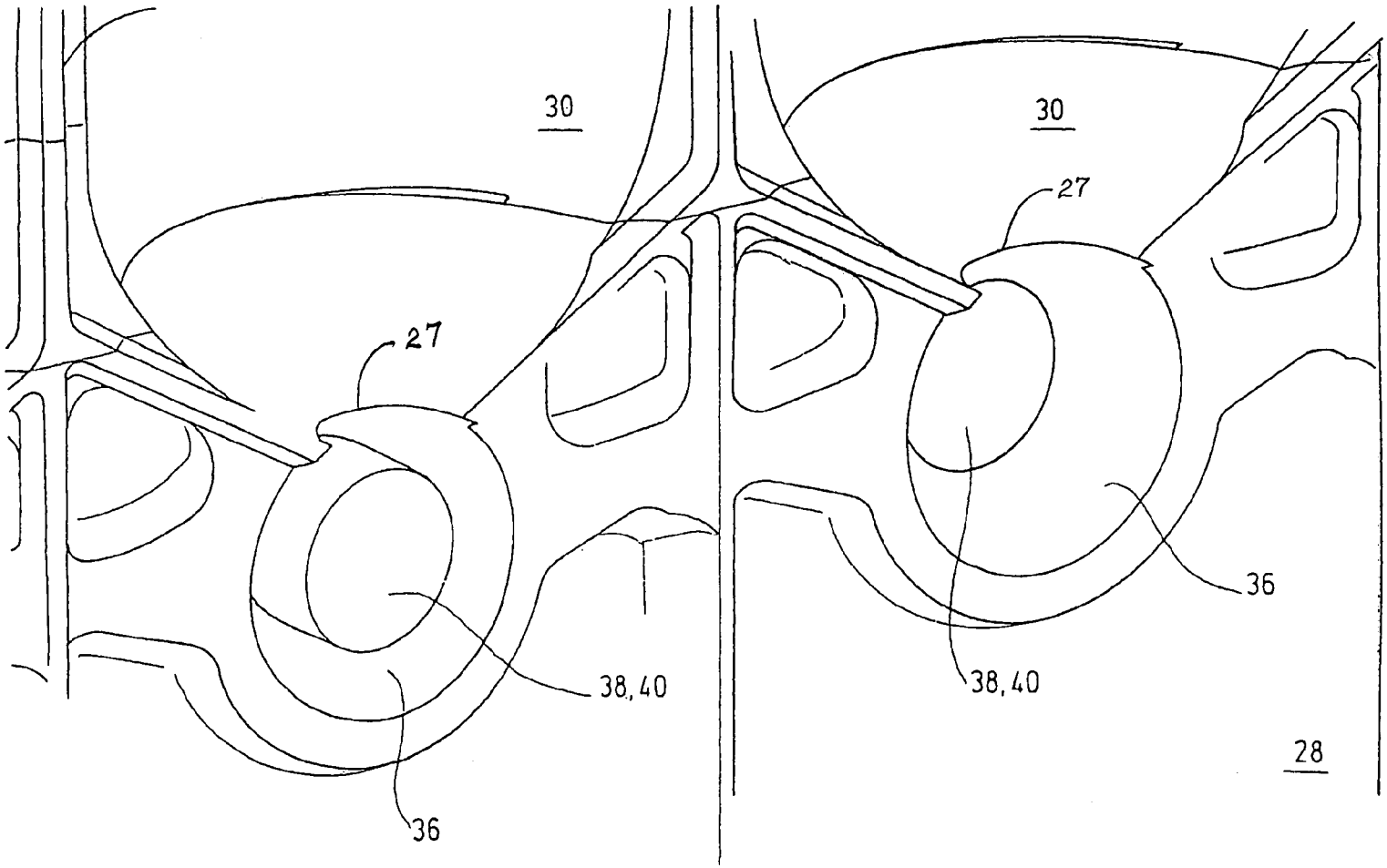
FIG. 5 is an enlarged, partial perspective view rotated by 180° relating of the molding tool shown in FIG. 4, with the plunger extended (left side) and with it retracted (right side)
Figure 6:
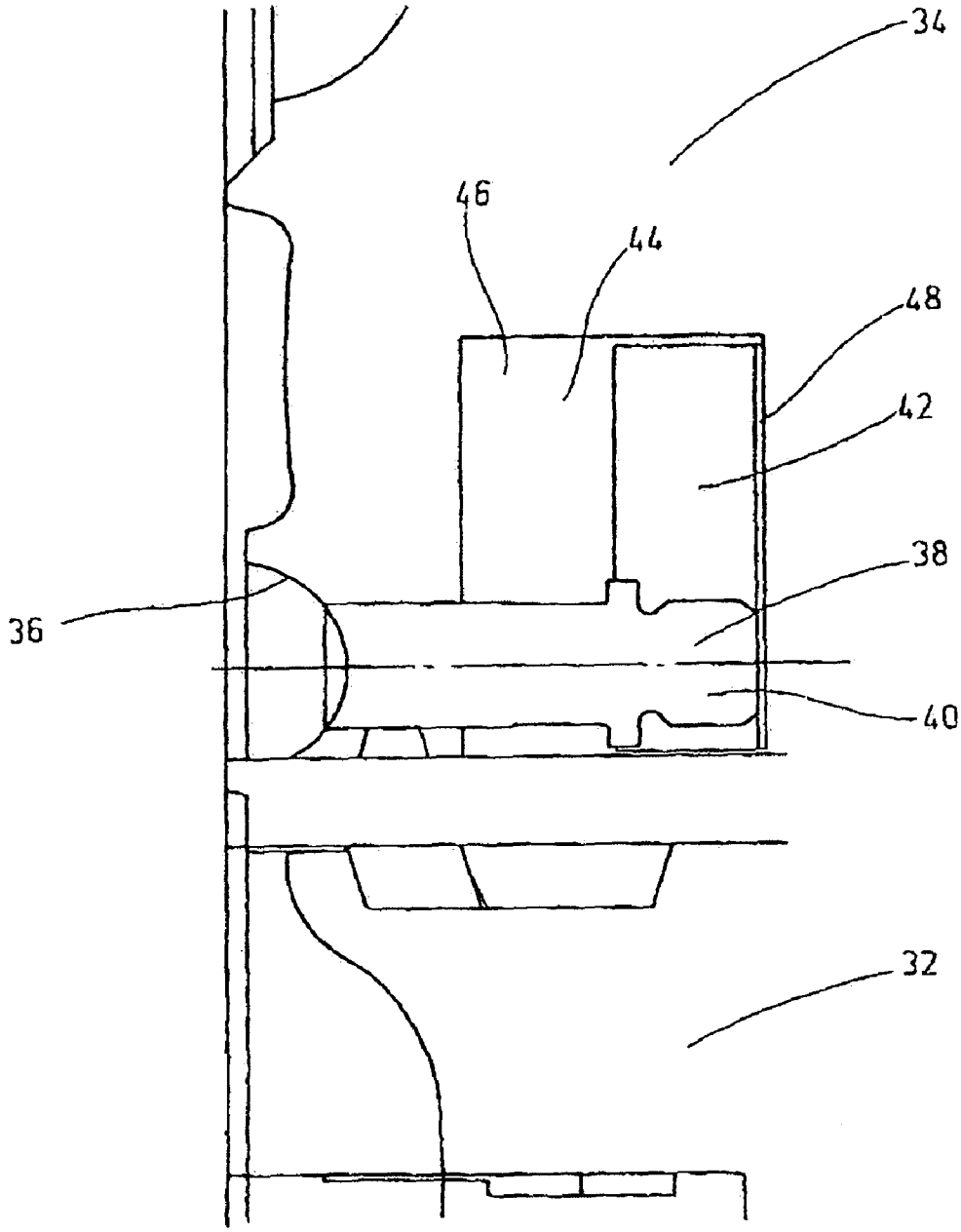
FIG. 6 is a side elevational view in section through the molding tool shown in FIG. 4 for a container production mold.

The device according to the exemplary embodiment of the present invention for producing the container shown in FIGS. 1 to 3 is shown in FIGS. 4-6. The device has at least two receptacle mold jaws 28 for producing the head component 16 of the container. In FIG. 4, one of the two mold jaws 28 is only half shown. To open and close the mold, a second mold jaw (not detailed) with the corresponding mold recesses 30 is moved away from or towards the illustrated mold jaw 28 shown in FIG. 4. Generally the two mold jaws 28 are moved uniformly toward each other or away from each other. These mechanical molding devices are conventional, and are in pertinent use in the field of blow-fill-seal processes, as have become known under the trade name "Bottelpack®", for example.

In the mold jaw 28, as shown in FIG. 4, another head mold jaw 32, underneath mold jaw 28 and shown only partially, is used for shaping for the respective receptacle element 10. A sealing mold jaw 34 is located above mold jaw 28. Depending on the selected molding process, the mold jaws can be triggered jointly. The possibility also exists of moving the individual mold jaws against each other, for example, initially a pair of mold jaws 28 for producing the head component or sealing element 16, 18, and only then to trigger the other pairs of mold jaws 32 to obtain the desired hollow receiving bodies 10 for a container.

As FIG. 4 shows, mold recesses 36 formed in the respective mold jaw 28 to form the hollow chamber 14 or the wall components of the sealing element 18 that border the hollow chamber 14. Viewed in FIG. 4, in turn, the tool located at the far right is designed for container manufacture, in which the hollow chamber 14 is designed as a full hollow ball according to the container configuration according to the representation in FIG. 1 at the extreme right. It is quite possible to combine the free hollow chamber cross sections and those with reduced hollow chamber cross sections with each other for different containers within the mold tool, if this is deemed necessary for reasons of practicability.

As FIGS. 5 and 6 furthermore show, mold parts 38, designed preferably as individual plungers 40, can be triggered within the mold recesses 36 relating to the respective hollow chamber 14. This mold part 38 extends through the dome-shaped or hemispherical mold recess 36 within the respective mold jaw 28. These conditions are shown especially distinctly in FIG. 5, which figure is shown rotated by 180° compared to FIG. 4, i.e., the mold recesses 30 for the receiving bodies 10 viewed in FIG. 5 are shown at the top and the sealing elements 18 located opposite are pointing down.

To produce a spherical hollow chamber 14, viewed in FIG. 5, the right plunger 40 remains behind. To displace the wall components 22, the left plunger 40 for forming the hollow chamber volume according to the present invention is extended forward and projects into the hemispherical recess 36, preferably to such an extent that the then pertinently displaced wall section as the wall component 22 comes into contact with the displaced wall component 22 of the plunger 40 of another corresponding mold jaw tool, which plunger is opposite in the longitudinal direction in one axis and is not detailed.

If the objective is an undisrupted hollow chamber cross section, it is of course also possible, instead of a retracted cylindrical plunger 40 as shown in FIG. 5, to completely omit it and make the mold in the conventional manner as is customary. If the hollow chamber 14 has a different geometrical structure instead of the illustrated spherical shape, adaptation of the free working cross section of the plunger 40 used at the time may be necessary. If the mold jaw 28 shown in FIG. 4 relates to a separately triggerable partial mold, in this respect in a configuration of a modular concept the replacement of the mold jaw 28 by another is easily possible in this way to be able to produce different container geometries, also in terms of the head-closure side, with only one molding device or molding machine.

FIG. 6 illustrates a longitudinal section through the associated molding tool to the mold jaw structure shown in FIG. 4. As shown in FIG. 6, the plunger 40 is held in a guide plate 42 within a control chamber 44 separating the two component spaces 46, 48 from each other within chamber 44. If these component spaces 46, 48 are connected to an energy input, for example, in the form of a pneumatic input, the plunger 40 can be shifted to the left out of its inactive position shown in FIG. 6, for example, to assume an active position as shown in FIG. 5 for complete of the displacement of the wall component.

By applying pressure in the chamber 46 and depressurizing the partial chamber 48, the plunger 40 can be moved back into its inactive position, in which the free front side of the plunger 40 still overlaps the dome bottom of the domed mold recess 36. Motion sensors (not detailed) can monitor the pertinent operating position of the plunger 40 and relay it to a central control (not detailed) for the machine. Instead of the guide plate 42, in one embodiment of the apparatus design according to the present invention (not detailed), the plunger 40 can be triggered directly by a working medium or energy medium. The use of electromagnets would also be possible, as have been used for years, for example, in magnetic valve technology to be able to trigger plunger motion. It is also possible to allow at least part of the plunger 40 to move in an oblique configuration instead of a transverse configuration, if the required container geometry compels this.

What is claimed is:

1. A molded container, comprising:

a hollow receptacle element holding a medium to be dispensed therefrom;

a dispensing opening on said receptacle element providing fluid communication between inside of and outside of said receptacle element; and a sealing element having a hollow chamber therein in fluid communication with and maintaining said dispensing opening clear and forming a head component for said receptacle element, said sealing element being detachably connected to said receptacle element by a separation point in an area of said dispensing opening and having opposite wall components displaced into said hollow chamber in a non-stressed state to reduce a free volume of said hollow chamber and to inhibit said medium from being able to penetrate into said hollow chamber, said wall components being spaced from said separation point.

2. A molded container according to claim 1 wherein said wall components are displaced to extend one of transversely and obliquely relative to said dispensing opening.

3. A molded container according to claim 1 wherein said wall components are displaced to touch one another in said hollow chamber.

4. A molded container according to claim 3 wherein chamber segments of said hollow chamber are left exposed by said wall components and are in fluid communication with said dispensing opening to at least partially carry said medium.

5. A molded container according to claim 4 wherein said medium has a sufficiently large surface tension to prevent entry thereof into the respective chamber segment, even in droplet form.

6. A molded container according to claim 1 wherein said hollow chamber has an outer peripheral side formed from wall pieces of a hollow ball.

7. A molded container according to claim 4 wherein together said chamber segments form a closed annular space encompassing said wall components.

8. A molded container, comprising:

a hollow receptacle element holding a medium to be dispensed therefrom;

a dispensing opening on said receptacle element providing fluid communication between inside of and outside of said receptacle element; and a sealing element having a hollow chamber therein in fluid communication with and maintaining said dispensing opening clear and forming a head component for said receptacle element, said sealing element being detachably connected to said receptacle element by a separation point in an area of said dispensing opening and having opposite wall components displaced into said hollow chamber in a non-stressed state to reduce a free volume of said hollow chamber and to inhibit said medium from being able to penetrate into said hollow chamber, said wall components being displaced to touch one another in said hollow chamber.

9. A molded container according to claim 8 wherein said wall components are displaced to extend one of transversely and obliquely relative to said dispensing opening.

10. A molded container according to claim 8 wherein chamber segments of said hollow chamber are left exposed by said wall components and are in fluid communication with said dispensing opening to at least partially carry said medium.

11. A molded container according to claim 10 wherein said medium has a sufficiently large surface tension to prevent entry thereof into the respective chamber segment, even in droplet form.

12. A molded container according to claim 8 wherein said hollow chamber has an outer peripheral side formed from wall pieces of a hollow ball.

13. A molded container according to claim 10 wherein together said chamber segments form a closed annular space encompassing said wall components.

* * * * *